US010004968B2

(12) United States Patent
Valadez et al.

(10) Patent No.: US 10,004,968 B2
(45) Date of Patent: Jun. 26, 2018

(54) HELMET TRAINING AID

(71) Applicants: Steven Valadez, Schertz, TX (US); James Yarbrough, Schertz, TX (US)

(72) Inventors: Steven Valadez, Schertz, TX (US); James Yarbrough, Schertz, TX (US)

( * ) Notice: Subject to any disclaimer, the term of this patent is extended or adjusted under 35 U.S.C. 154(b) by 0 days. days.

(21) Appl. No.: 15/665,594

(22) Filed: Aug. 1, 2017

(65) Prior Publication Data

US 2018/0036617 A1 Feb. 8, 2018

Related U.S. Application Data

(60) Provisional application No. 62/370,829, filed on Aug. 4, 2016.

(51) Int. Cl.

| | |
|---|---|
| ***A63B 71/02*** | (2006.01) |
| ***A42B 1/06*** | (2006.01) |
| ***A63B 69/00*** | (2006.01) |
| ***A42B 3/04*** | (2006.01) |

(52) U.S. Cl.

CPC ..... *A63B 69/0002* (2013.01); *A42B 3/0406* (2013.01); *A63B 2069/0008* (2013.01)

(58) Field of Classification Search

USPC ..... 2/10, 15, 410, 422, 423, 425, 455

See application file for complete search history.

(56) References Cited

U.S. PATENT DOCUMENTS

| | | | | |
|---|---|---|---|---|
| 5,479,658 | A * | 1/1996 | Harris | A42B 3/20 2/424 |
| 6,938,272 | B1 * | 9/2005 | Brown | A42B 3/20 2/424 |
| 7,322,693 | B2 | 1/2008 | Abraham | |
| 8,091,150 | B2 | 1/2012 | Bengochea | |
| 8,387,169 | B2 * | 3/2013 | Shockman | A42B 3/0406 2/410 |
| 8,512,172 | B1 | 8/2013 | Glynn | |
| 2004/0214141 | A1 | 10/2004 | Robinson | |
| 2008/0000016 | A1 * | 1/2008 | Kellogg | A42B 3/0406 2/410 |
| 2009/0290120 | A1 * | 11/2009 | Abraham | A61F 9/045 351/158 |

* cited by examiner

*Primary Examiner* — Nini Legesse

(74) *Attorney, Agent, or Firm* — Global Intellecutal Property Agency, LLC; Jordan Sworen

(57) ABSTRACT

A helmet training aid for obscuring the vision of a user. The helmet training aid includes a panel having a pair of distal ends securely affixed to a pair of opposing blinders. A fastener is secured at a lower end of each blinder, wherein the fastener removably secures each blinder to an opposing side of a helmet such that an upper end of each blinder covers an open portion of the helmet therebetween a brim and a cage of the helmet. The panel contains one or more fasteners on a first surface that removably secures to the cage of the helmet. In an alternative embodiment, opposing sidewalls of the blinders flare outwardly from the lower end to the upper end, the fastener on each blinder is secured to a protrusion at the lower end, and the panel is made of a mesh material.

18 Claims, 5 Drawing Sheets

HELMET TRAINING AID

CROSS REFERENCE TO RELATED APPLICATION

This application claims the benefit of U.S. Provisional Application No. 62/370,829 filed on Aug. 4, 2016. The above identified patent application is herein incorporated by reference in its entirety to provide continuity of disclosure.

BACKGROUND OF THE INVENTION

The present invention relates to improvements in baseball and softball training aids. More specifically, the present invention provides a training aid that attaches to a sports helmet to obscure both the peripheral and frontal vision of a user.

Many baseball and softball players participate in batting practice or training to improve their hitting skills. A major reason some players fail to make contact with a thrown ball is that they do not have the requisite focus directed toward the ball. A slight movement of the head may be enough to cause the player to lose concentration on the ball. When a player takes their eye off the ball, there is not enough time to reacquire focus on the ball and make a proper swing at the ball as it approaches the plate. There exists a need for a device that can allow the player to focus on an approaching ball without becoming distracted.

Devices have been disclosed in the known art that relate to sport training aids. These include devices that have been patented and published in patent application publications. These devices generally relate to training aids for helmets or head bands that partially block the peripheral vision of a user. These known art devices have several drawbacks. Some devices are permanently secured to a helmet and fail to provide a means to removably secure the device. Many of these devices only obscure the peripheral vision of a user and fail to obscure any of the frontal vision. Further, some devices lack a means to removably secure the device to a front portion of a cage of a helmet.

In light of the devices disclosed in the known art, it is submitted that the present invention substantially diverges in design elements from the known art and consequently it is clear that there is a need in the art for an improvement to existing sport training aid devices. In this regard, the instant invention substantially fulfills these needs.

SUMMARY OF THE INVENTION

In view of the foregoing disadvantages inherent in the known types of sport training aids now present in the known art, the present invention provides a new helmet training aid wherein the same can be utilized for providing convenience for obscuring the peripheral and frontal vision of a user when practicing hitting a ball.

It is therefore an object of the present invention to provide a new and improved helmet training aid device that has all of the advantages of the prior art and none of the disadvantages.

It is another object of the present invention to provide a helmet training aid comprising a panel having a pair of distal ends and a pair of opposing blinders, wherein a first distal end securely affixes to a first blinder and a second distal end securely affixes to a second blinder. A fastener secures to a lower end of each the first and second blinder, wherein the fastener removably secures each blinder to an opposing side of a helmet such that an upper end of each blinder covers an open portion of the helmet therebetween a brim and a cage of the helmet and a first surface of the panel rests flush against the cage of the helmet.

Another object of the present invention is to provide a helmet training aid wherein each blinder has opposing sidewalls that flare outwardly from the lower end to the upper end and further comprise a protrusion at the lower end of each blinder wherein the fastener is securely affixed.

Another object of the present invention is to provide a helmet training aid wherein one or more fasteners are secured to a first surface of the panel configured to removably secure to a cage of a helmet.

Another object of the present invention is to provide a helmet training aid wherein each blinder contains an elongated aperture configured to receive a distal end of the panel, such that the distal end slides through the aperture and folds over a sidewall creating a loop, wherein the loop is secured to the blinder by a seam.

Yet another object of the present invention is to provide a helmet training aid wherein a pair of adapter members containing a pair of fasteners removably secures to the fastener at the lower end of each blinder, such that a first fastener of the pair of fasteners removably attaches to the fastener at the lower end of the blinder and a second fastener attaches to the opposing side of the helmet.

Another object of the present invention is to provide a helmet training aid that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
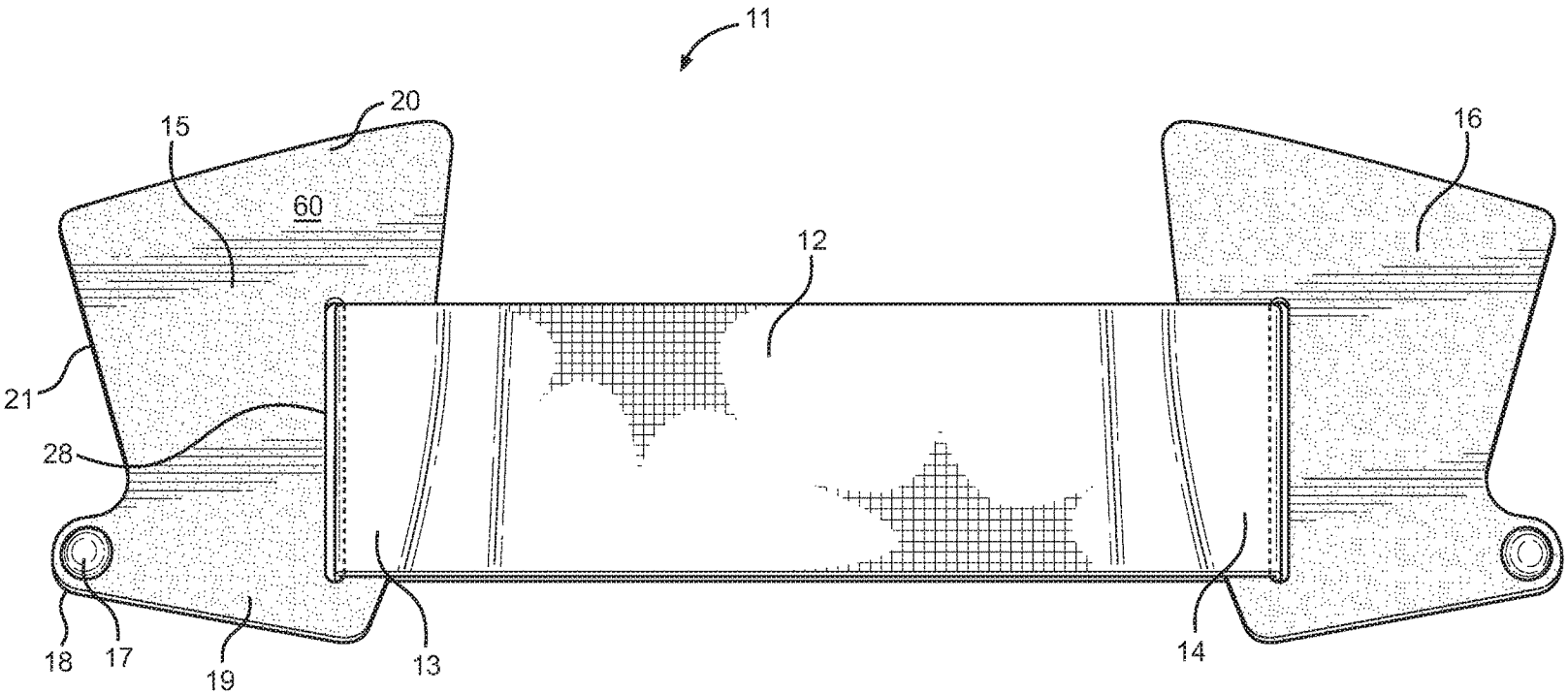
FIG. 1 shows a front view of the helmet training aid.

Reference is made herein to the attached drawings. Like reference numerals are used throughout the drawings to depict like or similar elements of the helmet training aid. For the purposes of presenting a brief and clear description of the present invention, the preferred embodiment will be discussed as used for obstructing the peripheral and frontal vision of a user when the device is attached to a helmet. The figures are intended for representative purposes only and should not be considered to be limiting in any respect.

Figure 2:
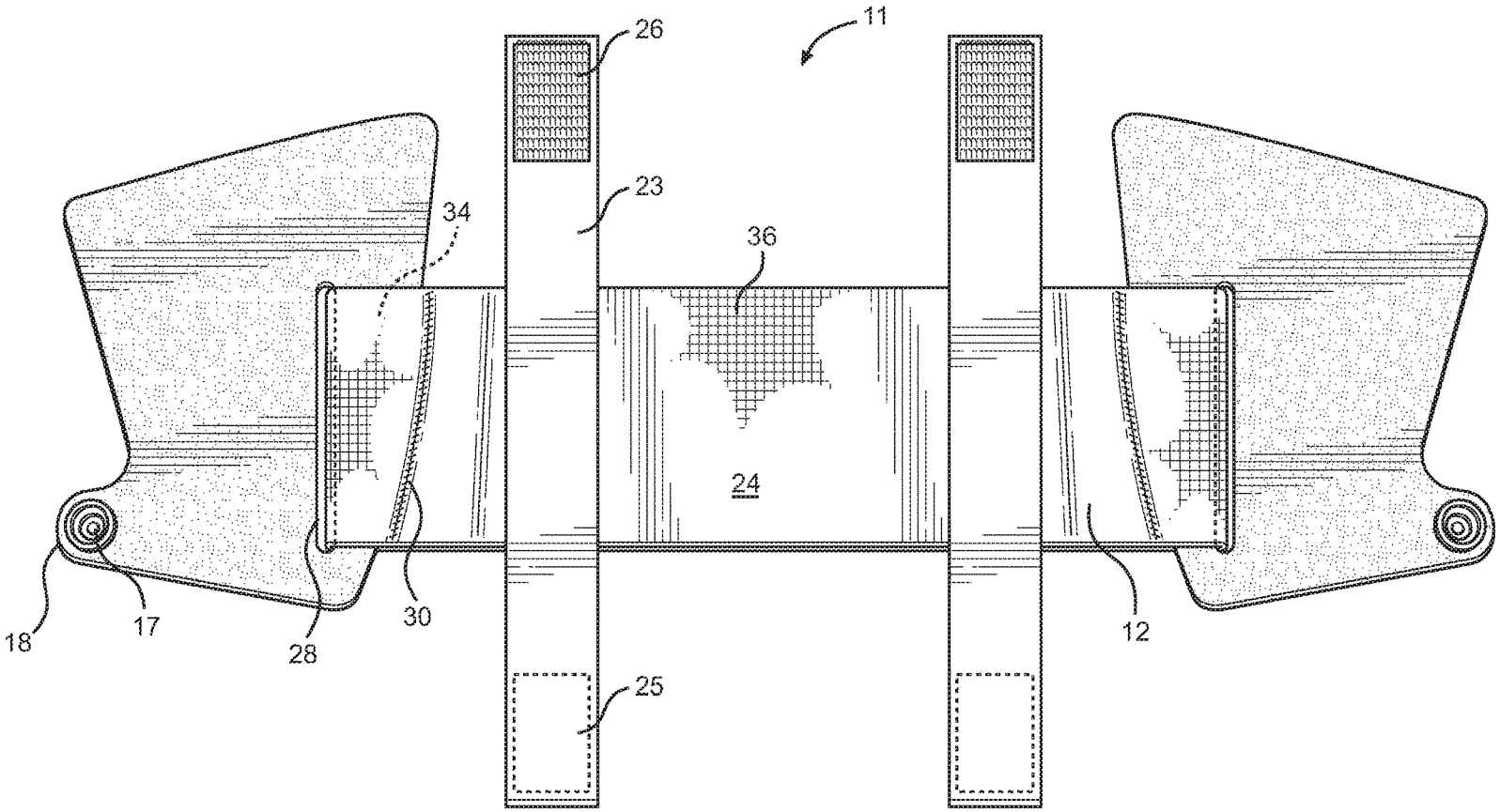
FIG. 2 shows a rear view of the helmet training aid.

Referring now to FIG. 1 and FIG. 2, there is shown a front view of the helmet training aid and a rear view of the helmet training aid, respectively. The helmet training aid 11 comprises a panel 12 having a first distal end 13 and a second distal end 14, and a pair of blinders secured thereto. In the illustrated embodiment, the panel 12 comprises a rectangular shape and is composed of a fabric material. However, in alternate embodiments, the panel 12 is composed of a suitable material configured to conform to the shape of a cage of a helmet. A first blinder 15 is secured to the first distal end 13 of the panel 12 and a second blinder 16 is secured to the second distal end 14 of the panel 12, such that the first blinder 15 and the second blinder 16 oppose each other.

In the illustrated embodiment, each blinder 15, 16 comprises a planar surface 60 having opposing sidewalls 21 that flare outwardly from a lower end 19 to an upper end 20. In the illustrated embodiment, an edge of both the lower end 19 and upper end 20 is sloped relative to the panel 12, such that a first corner each end 19, 20 extends beyond a second corner of each end 19, 20. The first corners of the lower and upper end 19, 20 are defined as being positioned closest to the panel 12. In the illustrated embodiment, the edge of the upper end 20 comprises a steeper slope than the edge of the lower end 19.

Each blinder 15, 16 further comprises a protrusion 18 at the lower end 19 wherein a fastener 17 is secured. The fastener 17 is configured to removably secure a blinder to an opposing side of a helmet, such that the upper end 20 of the blinder covers an open portion of the helmet, therebetween a brim and the cage of the helmet. The open portion of the helmet that is adapted to be covered by the blinders is in line with the peripheral vision of a user when in an attached position. The fastener 17 on the lower end 19 of the blinder can be any type of fastener, such as a button snap, which typically is used on opposing sides of a standard baseball or softball helmet. The protrusion 18 located at the lower end 19 of each blinder 15, 16, is configured to position the blinder on the opposing side of the helmet, such that an ear hole on a sidewall of the helmet remains exposed. This allows a user to still hear a sound while the device 11 is in an attached position.

In the illustrated embodiment, each blinder 15, 16 further comprises an elongated aperture 28 on the planar surface 60 thereof. The elongated aperture is configured to secure a distal end 13, 14 of the panel 12 to each blinder. A distal end of the panel 12 is secured to the blinder by threading the distal end through the elongated aperture 28 and folding the distal end over a sidewall 34 of the blinder thereby creating a loop. The loop is secured to the blinder by a seam 30. The loop is secured tightly to the blinder such that an inner surface of the loop rests flush against a surface of the sidewall 34 of the blinder. The tight fit secures the panel 12 to the blinders 15, 16 such that there is no movement of the distal ends 13, 14 of panel 12 when the device is in the attached position.

The helmet training aid 11 further comprises one or more fasteners 23 secured to a first surface 24 of the panel 12. The one or more fasteners 23 removably secures the panel 12 to the cage of the helmet. In the illustrated embodiment, each of the one or more fastener 23 has a pair of distal ends 25 containing hook and loop material 26. The pair of distal ends 25 removably secures the panel 12 to the helmet by forming a loop around the cage of the helmet. The one or more fasteners secure the panel to the cage thereby preventing any movement of the panel when in the attached position. In the illustrated embodiment, the panel 12 is constructed of a mesh material 36, such as nylon. The mesh material 36 allows a user to easily breath through the material when the panel 12 is attached to the cage of the helmet, while still obstructing a lower portion of the frontal vision of a user. The lower portion of the frontal vision that is obstructed by the panel 12 is the visual area that is in line with the cage of the helmet. Further, in some embodiments, the panel 12 is configured to stretch in order to fit cages of various sizes.

Figure 3:
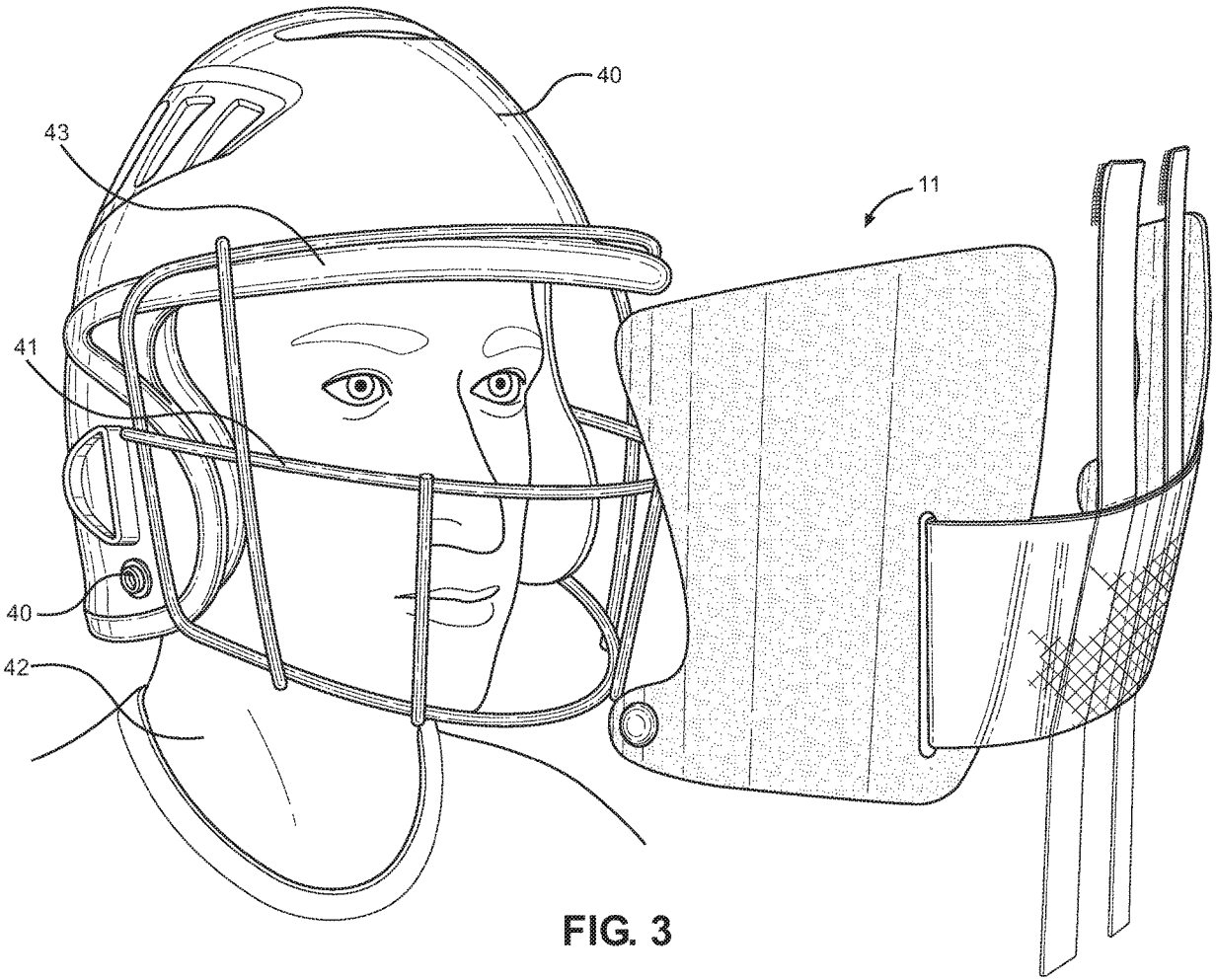
FIG. 3 shows a perspective view of the helmet training aid in a detached position.
Figure 4:
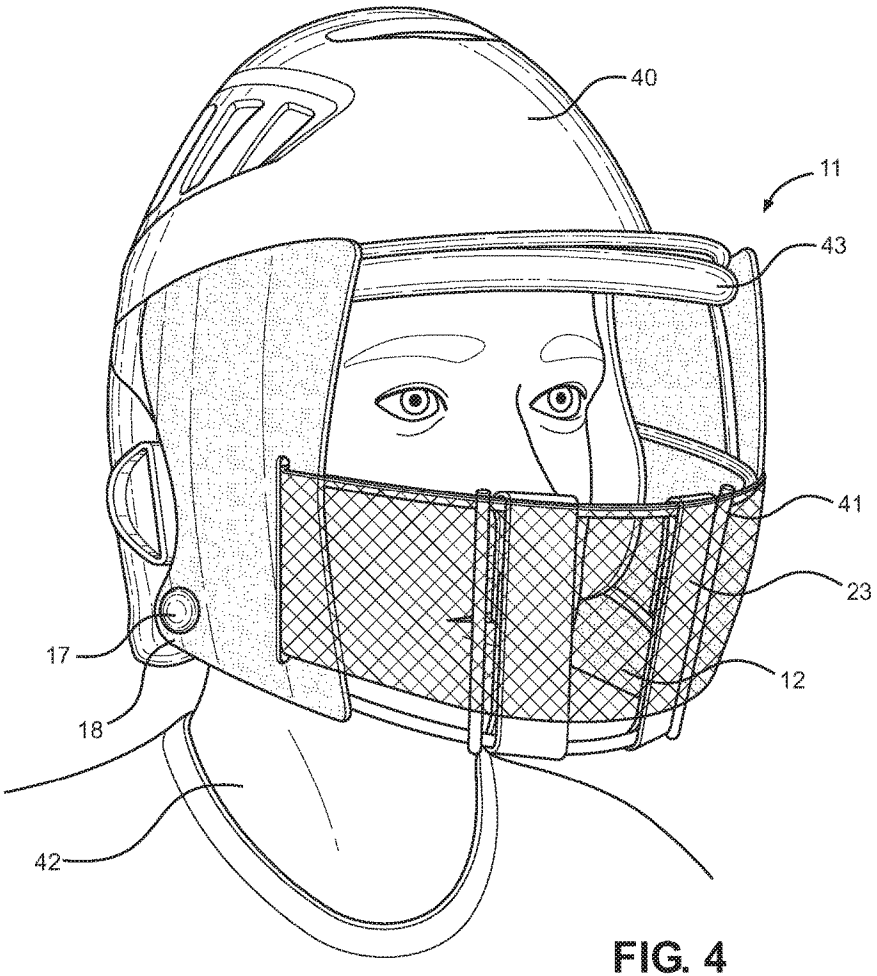
FIG. 4 shows a perspective view of the helmet training aid in an attached position.

Referring now to FIG. 3 and FIG. 4, there are shown perspective views of the helmet training aid in a detached position and an attached position, respectively. When in a detached position, the frontal vision and peripheral vision of a user 42 wearing a helmet 40 is unobstructed at the open portion of the helmet 40 therebetween the brim 43 and the cage 41. In the detached position, the eyes of the user 42 are permitted to wander therein the open portion of the helmet, when trying to focus on hitting a ball with a bat. Because the eyes can wander, the user 42 can become easily distracted by any movement other than the movement of a pitched ball. When distracted, the user becomes less likely to hit the ball.

When in an attached position, the helmet training aid 11 is removably secured to the opposing sides of a helmet 40 by utilizing the fastener 17 thereon the protrusion 18 at the lower end of each blinder. When in the attached position, the upper end of each blinder covers the open portion of the helmet, therebetween a brim 43 and a cage 41 of the helmet 40. Each blinder is configured to obstruct the peripheral vision of the user, when in the attached position. Furthermore, the panel 12 is configured to rest flush over the cage 41 of the helmet 40 and removably secure thereto by utilizing the one or more fasteners 23. In the illustrated embodiment, the distal ends of the one or more fasteners 23 contain hook and loop material that loop around the cage 41 of the helmet 40. When in the attached position, the device obstructs both the peripheral vision and the lower portion of the frontal vision in line with the cage. When in the attached position, the open portion of the helmet is constricted to a viewing window between a sidewall of each blinder, the brim of the helmet, and a top end of the panel, such that the user can only focus on the pitched ball.

Figure 5:
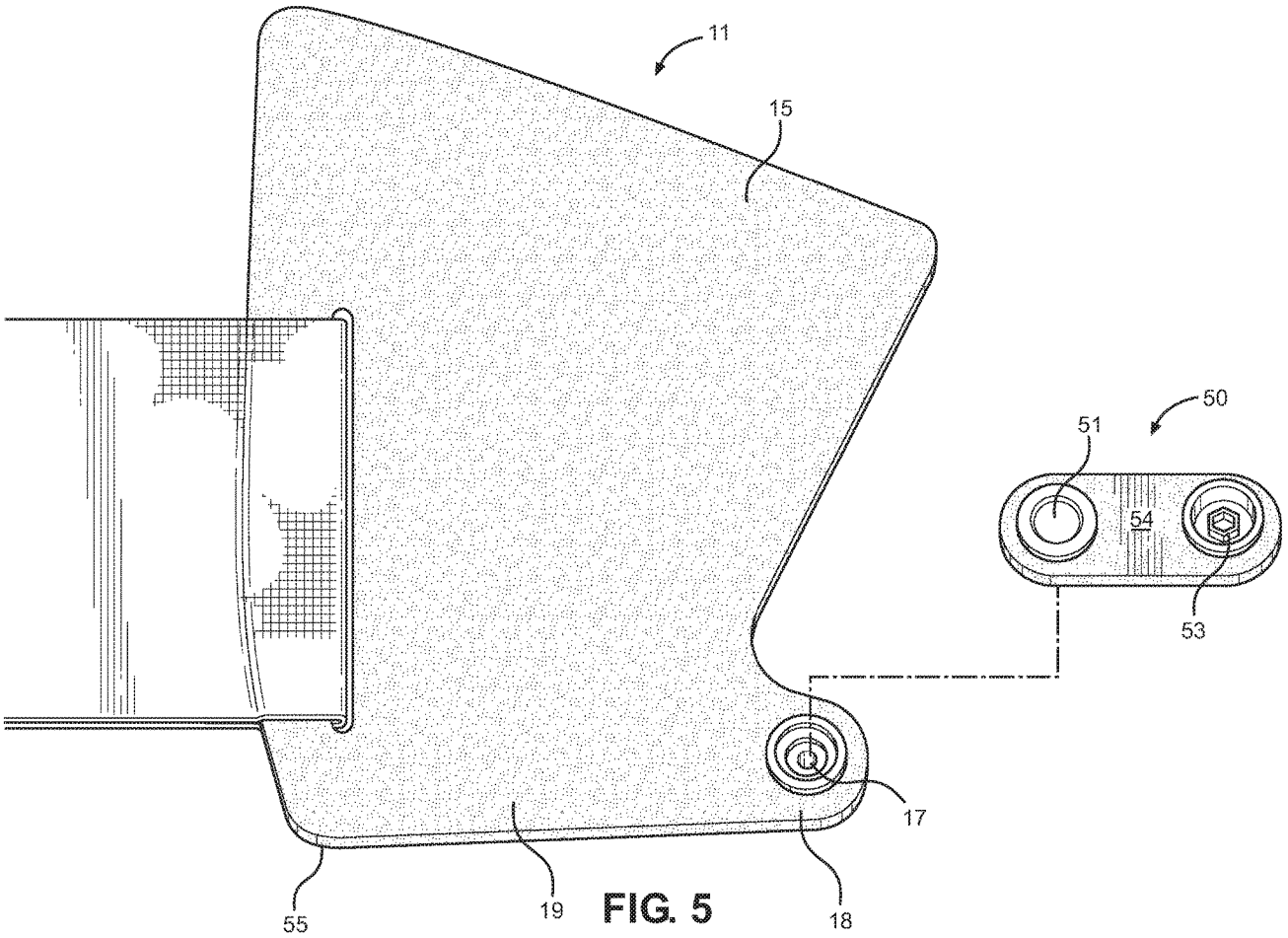
FIG. 5 shows an exploded view of an adapter member and a first blinder of the helmet training aid.

Referring now to FIG. 5, there is shown an exploded view of an adapter member and a first blinder of the helmet training aid. The helmet training aid 11 further comprises a pair of adapter members 50 each having a first fastener 51 and a second fastener 53. In the illustrated embodiment, the first fastener 51 and second fastener 53 are positioned on opposing surfaces of an adapter member 50, such that the first fastener 51 is on a first surface and a second fastener 53 is on a second surface 54. The first fastener 51 removably secures to the fastener 17 thereon the protrusion 18 at the lower end 19 of the blinder 15. The second fastener 53 removably secures the adapter member to an opposing end of a helmet. The pair of adapter members 50 can be any length, in order to allow the helmet training aid 11 to be secured to varying sized helmets such that the adapter member increases the length of the device to accommodate a larger distance between the opposing side of the helmet.

Both blinders and the pair of adapter members are constructed of a durable material, such as styrene, in order to prevent breakage when being struck by a ball or a bat. In the illustrated embodiment, both the blinder 15 and the adapter member 50 comprise a thickness 55 of 0.06 inches. This allows the blinder 15 and the adapter member 50 to be flexible, such that when the device 11 is in the attached position, both the blinder and the adapter can be bendable over the cage of the helmet. However, in alternative embodiments, the thickness can be any suitable thickness that maintains flexibility.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A helmet training aid, comprising:

a panel having a first distal end and a second distal end;

a first blinder secured to the first distal end and a second blinder secured to the second distal end, such that the first blinder and the second blinder oppose each other;

a fastener secured to a lower end of each of the first and second blinder;

wherein the fastener removably secures each of the first and second blinder to an opposing side of a helmet, such that an upper end of each of the first and second blinder covers an open portion of a helmet, between a brim and a cage of a helmet;

a first surface of the panel is configured to align with a cage of a helmet when the first and second blinder are secured to opposing sides of the helmet;

wherein each blinder contains an elongated aperture configured to secure a distal end of the panel, such that the distal end slides through the elongated aperture and folds over a sidewall creating a loop, wherein the loop is secured to the blinder by a seam.

2. The helmet training aid of claim 1, wherein the fastener is secured to a protrusion at the lower end of each blinder.

3. The helmet training aid of claim 1, wherein the fastener of each blinder is a button snap.

4. The helmet training aid of claim 1, wherein each blinder has opposing sidewalls that flare outwardly from the lower end to the upper end.

5. The helmet training aid of claim 1, wherein one or more fasteners are secured to a first surface of the panel configured to removably secure to a cage of a helmet.

6. The helmet training aid of claim 5, wherein each of the one or more fasteners have a pair of distal ends containing hook and loop material configured to removably secure to one another to form a loop.

7. The helmet training aid of claim 1, wherein the panel is made of a mesh material.

8. The helmet training aid of claim 1, wherein a pair of adapter members each containing a pair of fasteners removably secures to the fastener at the lower end of each blinder, such that a first fastener of the pair of fasteners removably secures to the fastener at the lower end of the blinder and a second fastener of the pair of fasteners removably secures to an opposing side of a helmet.

9. The helmet training aid of claim 8, wherein the pair of fasteners on each adapter member are on opposing surfaces, such that the first fastener is on a first surface and the second fastener is on a second surface.

10. The helmet training aid of claim 9, wherein the pair of fasteners are button snaps.

11. The helmet training aid of claim 8, wherein the adapter members are made of sytrene.

12. The helmet training aid of claim 8, wherein the adapter members have a thickness of 0.06 inches.

13. The helmet training aid of claim 1, wherein the blinders are made of sytrene.

14. The helmet training aid of claim 1, wherein the blinders have a thickness of 0.06 inches.

15. The helmet training aid of claim 1, wherein an edge of both the lower end and upper end of each of the first and second blinders are sloped relative to the panel, such that a first corner of each of the lower and upper end extends beyond a second corner of each of the lower and upper end, wherein the first corners of the lower and upper end are defined as being positioned closest to the panel.

16. The helmet training aid of claim 15, wherein the edge of the upper end comprises a steeper slope than the edge of the lower end.

17. A helmet training aid, comprising:

a panel having a first distal end and a second distal end;

a first blinder secured to the first distal end and a second blinder secured to the second distal end, such that the first blinder and the second blinder oppose each other;

a fastener secured to a lower end of each of the first and second blinder;

wherein the fastener removably secures each of the first and second blinder to an opposing side of a helmet, such that an upper end of each of the first and second blinder covers an open portion of a helmet, between a brim and a cage of a helmet;

a first surface of the panel is configured to align with a cage of a helmet when the first and second blinder are secured to opposing sides of the helmet;

wherein one or more fasteners are secured to the first surface of the panel configured to removably secure to a cage of a helmet;

wherein each of the one or more fasteners have a pair of distal ends containing hook and loop material configured to removably secure to one another to form a loop.

18. A helmet training aid, comprising:

a panel having a first distal end and a second distal end;

a first blinder secured to the first distal end and a second blinder secured to the second distal end, such that the first blinder and the second blinder oppose each other;

a fastener secured to a lower end of each of the first and second blinder;

wherein the fastener removably secures each of the first and second blinder to an opposing side of a helmet, such that an upper end of each of the first and second blinder covers an open portion of a helmet, between a brim and a cage of a helmet;

a first surface of the panel is configured to align with a cage of a helmet when the first and second blinder are secured to opposing sides of the helmet;

wherein a pair of adapter members each containing a pair of fasteners removably secures to the fastener at the lower end of each blinder, such that a first fastener of the pair of fasteners removably secures to the fastener at the lower end of the blinder and a second fastener of the pair of fasteners removably secures to an opposing side of a helmet.

* * * * *